US005358041A

United States Patent [19]

O'Hair

[11] Patent Number: 5,358,041

[45] Date of Patent: Oct. 25, 1994

[54] ROD GUIDE

[75] Inventor: Dan E. O'Hair, Conroe, Tex.

[73] Assignee: Enterra Patco Oil Field Products, Houston, Tex.

[21] Appl. No.: 67,730

[22] Filed: May 26, 1993

[51] Int. Cl.[5] ..... E21B 17/10

[52] U.S. Cl. ..... 166/241.4

[58] Field of Search ..... 166/241.1, 241.2, 241.4, 166/241.7, 176, 227

[56] References Cited

U.S. PATENT DOCUMENTS

| | | | |
|---|---|---|---|
| 1,605,316 | 11/1926 | Wilson | 166/241.2 |
| 1,716,247 | 6/1929 | Smith | 166/241.4 |
| 1,897,507 | 2/1933 | Morgan | 166/241.4 X |
| 2,153,787 | 4/1939 | Anderson | 166/241.4 |
| 3,399,730 | 9/1968 | Pourchot . | |
| 4,088,185 | 5/1978 | Carson | 166/176 |
| 4,099,564 | 7/1978 | Hutchison | 166/241.1 |
| 4,105,262 | 8/1978 | Richey . | |
| 4,258,804 | 3/1981 | Richey et al. . | |
| 4,343,518 | 8/1982 | Pourchot . | |
| 4,575,163 | 3/1986 | Sable . | |
| 4,600,063 | 7/1986 | Beasley . | |
| 4,640,349 | 2/1987 | Allen . | |
| 4,997,039 | 3/1991 | Sable | 166/241.4 |
| 5,115,863 | 5/1992 | Olinger . | |
| 5,247,990 | 9/1993 | Sudol et al. | 166/241.4 X |

*Primary Examiner*—Ramon S. Britts
*Assistant Examiner*—Frank S. Tsay
*Attorney, Agent, or Firm*—Gunn & Kuffner

[57] ABSTRACT

A rod guide in the form of a substantially cylindrical body molded in intimate contact with a sucker rod includes at least three blades or fins projecting from the body to define a smoothly continuous concave surface of the body. The ends of the blades form knife blades to reduce resistance to fluid flow about and through the rod guide and to reduce turbulent flow behind each blade. The disclosed structure offers increased strength against bending moment subjected to the rod guide, thereby increasing resistance to bending fracture and tensile elongation. This structure also increases erodable volume of rod guide material while maintaining flow about and through the rod guide.

6 Claims, 3 Drawing Sheets

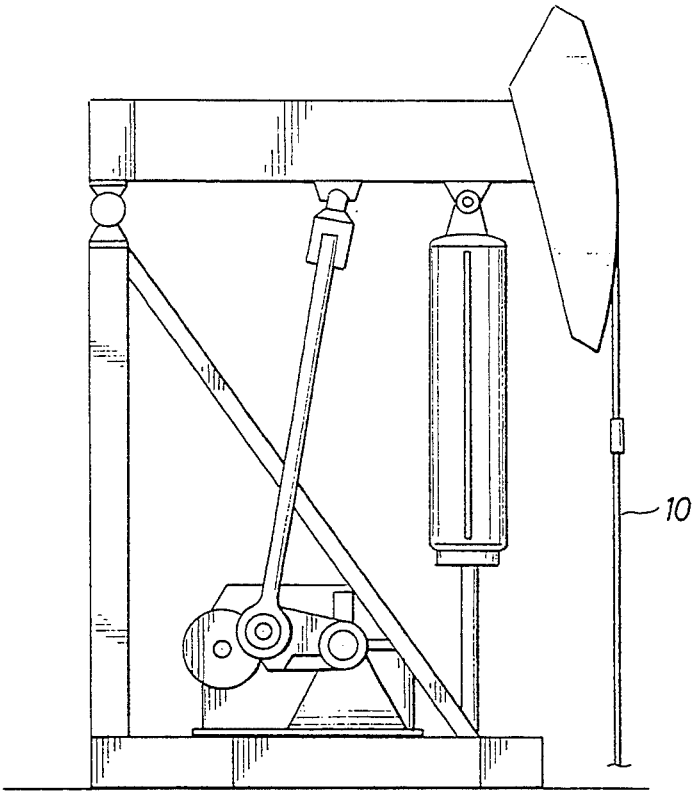
FIG. 1
(PRIOR ART)
FIG. 2A
(PRIOR ART)
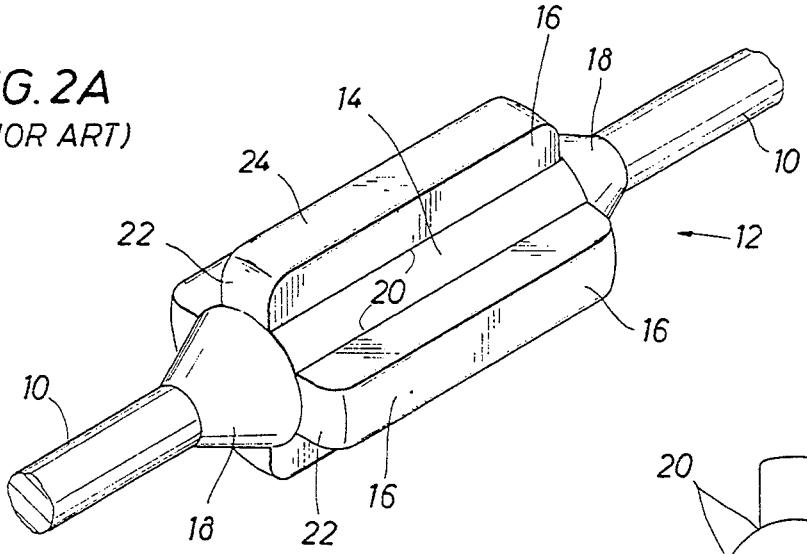
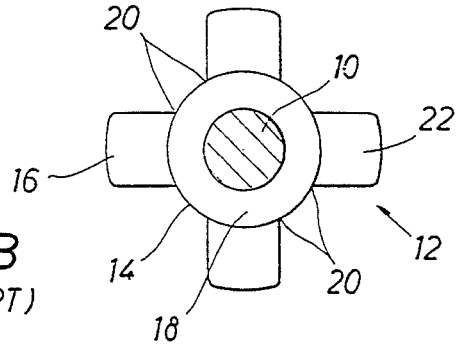
FIG. 2B
(PRIOR ART)

ROD GUIDE

FIELD OF THE INVENTION

The present invention relates generally to the field of guides for sucker rod strings and, more particularly, to a rod guide with a smoothly continuous concave body between its "fins" or "blades."

BACKGROUND OF THE INVENTION

Rod guides for centralizing sucker rods within production tubing are known in the prior art. As shown in FIG. 1, a pumping unit has attached thereto a sucker rod 10. (FIG. 1 was copied from U.S. Pat. No. 5,180,289 to Wenholz et al. and assigned to Baker Hughes Incorporated). At the bottom end of the sucker rod 10 is a reciprocating pump (not shown). As the pumping unit moves the sucker rod 10 down, the barrel of the reciprocating pump fills with the production fluid to be produced. Conversely, as the pumping unit moves the sucker rod up, a valve in the reciprocating pump shuts and the production fluid in the pump barrel is lifted, displacing production fluid above it and forcing one pump-barrel's worth of production fluid out of the hole.

The sucker rod must extend from the pumping unit all the way down to the reciprocating pump, which may be several thousand feet below the surface. Consequently, the sucker rod is subjected to a variety of stresses: compression, tension, torsion, and bending. Further, the sucker rod can "wobble" within the production tubing. This problem of "wobble" has been solved by the installation of rod guides on the sucker rod to centralize the sucker rod within the production tubing thereby controlling rod and tubing wear.

A prior art sucker rod guide includes a body that is molded in intimate contact with the sucker rod. The body has simultaneously molded therewith a plurality of "fins" or "blades" that extend radially from the body. As used herein, the term "fin" or "blade" refers to the molded portion of the rod guide that extends from the body to guidingly contact the interior surface of production tubing.

Known prior art rod guides include a convex contour of the body between blades. The location at which a blade meets the body thus defines an interior corner or root. It has been found that this interior corner is a weak spot in the rod guide and is inordinately more likely to fail than other regions of the rod guide. Thus, there remains a need for a rod guide without a convex portion of the body between the blades. In fact, this portion of the body preferably defines a strictly concave contour between blades.

In operation, the sucker rod is immersed in production fluid. As the sucker rod moves up and down to pump fluid from down hole, the rod guide provides resistance to the movement of the sucker rod due to hydraulic action of the fluid through and around the rod guide. Known rod guides have provided an extended length of the rod guide in order to give an adequate erodable volume of rod guide material while providing sufficient area through the rod guide for fluid flow. Known rod guides also present a flat (though slanted) aspect of the face of each blade to the fluid, both on the upstroke and the downstroke of the sucker rod. Such a flat aspect develops further resistance to fluid flow through the rod guide. Finally, the flat aspect of the face of each blade develops turbulent fluid flow behind the rod guide, further inhibiting movement of the rod guide up and down within the production tubing.

Thus, there remains a need for a rod guide that has an adequate volume of erodable material while maximizing cross sectional area for production fluid flow. Such a rod guide should present a smooth, contoured "knife-blade" aspect for the face of each fin of the rod guide to minimize resistance to the movement of the sucker rod and to eliminate turbulent fluid flow behind each fin.

As noted above, rod guides are subject to a variety of stresses. One such stress on rod guides results from a bending moment that has been shown to be one significant source of rod guide failure. One reason for this is that rod guides are primarily made of plastic that is molded directly upon a sucker rod. The material from which the rod guide is molded must conform to a standard from the National Association of Corrosion Engineers (NACE), Std. TM-01-87-Hydrocarbon Mixture With 500 psi gas consisting of 87.5% $CO_2$ and 12.5% $H_2S$. This standard dictates a material which is resistant to temperature and chemicals (e.g., $H_2S$, certain salts, etc.) and such a material is inherently brittle. Rod guides are commonly made of rieton, nylon, polyurethane, or the like.

To provide a predictable site for rod guide failure, Positive Action Tool Co. of Dallas action produced a rod guide known as "double-plus." "Double-plus" provided two pairs of fins, offset circumferentially from one another by 90°. However, such an arrangement apparently does nothing to reduce the likelihood of such a failure, it simply predetermines where such a failure will occur. Also, such a design presents the same resistance to fluid flow and, in fact, appears to make undesirable turbulent flow more likely.

Thus, there remains a need for a rod guide that is more robust to bending moment without sacrificing any of the other important features previously noted.

SUMMARY OF THE INVENTION

The present invention addresses these and other shortcomings of the prior art. The present invention comprises a rod guide with a concave body surface between the blades. This "concave body" surface feature eliminates the fillets between blades and rod guide body which presented a common failure mechanism in the prior art.

The leading edge of each blade presents a blade-like "stealth" aspect that minimizes resistance to fluid flow around the blades and through the rod guide. The thickness of the blades is preferably maintained as a constant value and the minimum thickness of the body between the blades is varied to maintain sufficient strength of the rod guide while maximizing fluid flow through the rod guide. The "stealth" aspect of the blades is variable, both axially (i.e., the slope along the body of the rod guide) and along the blade (i.e., the sharpness of the blade).

These and other features of the present invention will be readily apparent to those of skill in the art when they study the following detailed description in conjunction with the accompanying drawings.

BRIEF DESCRIPTION OF THE DRAWINGS

FIG. 1 depicts a prior art pumping rig with a sucker rod.

FIG. 2A is a perspective view of a prior art rod guide. FIG. 2B shows a front view of the prior art rod guide of FIG. 2A.

DETAILED DESCRIPTION OF A PREFERRED EMBODIMENT

Figure 3A:
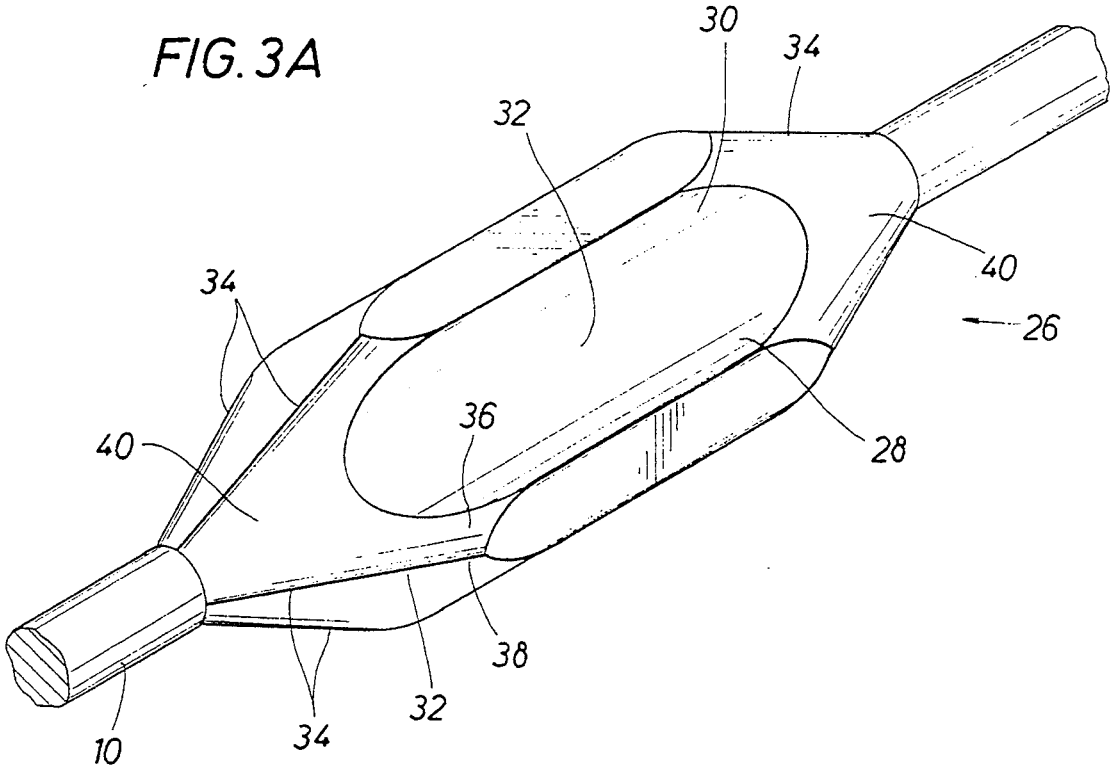
FIG. 3A is a perspective view of a rod guide of the present invention.

FIG. 2A depicts a prior art rod guide 12. The rod guide 12 is molded directly on the sucker rod 10 (see FIG. 1). Those of skill in the art will appreciate that a number of rod guides are spaced along the length of the sucker rod. The rod guide 12 comprises a body 14, a plurality of blades or fins 16, and a pair of frustoconical cylindrical end caps 18, all molded as a unitary piece. The body 14 is substantially a solid cylinder(molded onto the sucker rod) such that the area between each blade defines a convex surface. Each blade 16 meets the body 14 at a root or interior corner 20 (See FIG. 2B). The root 20 forms a relatively sharp angle between the body 14 and the blade. The root 20 has been found to define a relative weak spot on the rod guide and a source of a failure mechanism.

Each blade 16 presents a relatively flat aspect at a blade face 22. While each blade face 22 curves back onto a fin edge 24, this still presents a flat aspect like the sail area of the hull of a ship. This develops hydraulic resistance to the movement of the sucker rod string as it moves in the downward direction. This also creates turbulent fluid flow behind each blade as the sucker rod string moves down.

This feature of the prior art rod guide is also shown in FIG. 2B. The sucker rod 10 has a rod guide 12 molded thereon. The rod guide 12 comprises a body 14, a plurality of blades or fins 16, and a pair of frustoconical cylindrical end caps 18, all molded as a unitary structure. The blades 16 meet the body 14 at roots or interior corners 20. Each blade 16 presents a blade face 22 which resists the movement of the sucker rod in the downward direction. (The rod guide does not resist movement in the upward direction since there is no fluid flow through the rod guide as the sucker rod moves up.)

Figure 3B:
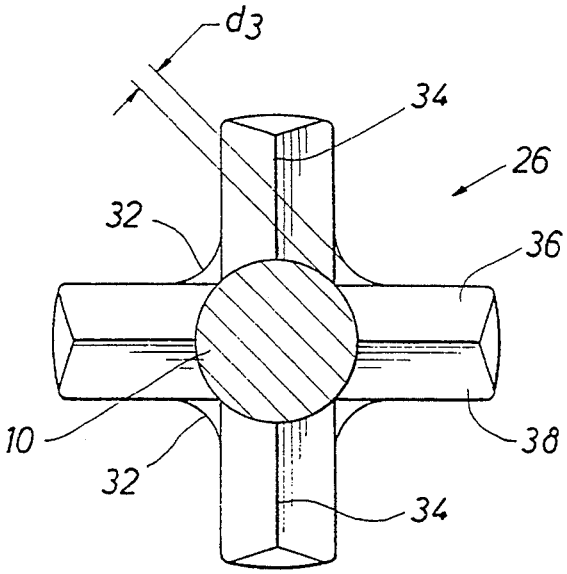
FIG. 3B shows a front view of the rod guide of FIG. 3A.

FIGS. 3A and 3B depict a rod guide 26 of the present invention. The rod guide 26 comprises generally a body 28 molded directly onto a sucker rod 10. The body 28 extends to form blades 30. The area of the body 28 between each blade defines a valley or concave surface 32. Thus, the surface of the body flows smoothly from one blade to each adjacent blade, eliminating the root or interior corner 20 of FIGS. 2A and 2B. Eliminating this weak spot eliminates a known failure mechanism.

Figure 5A:
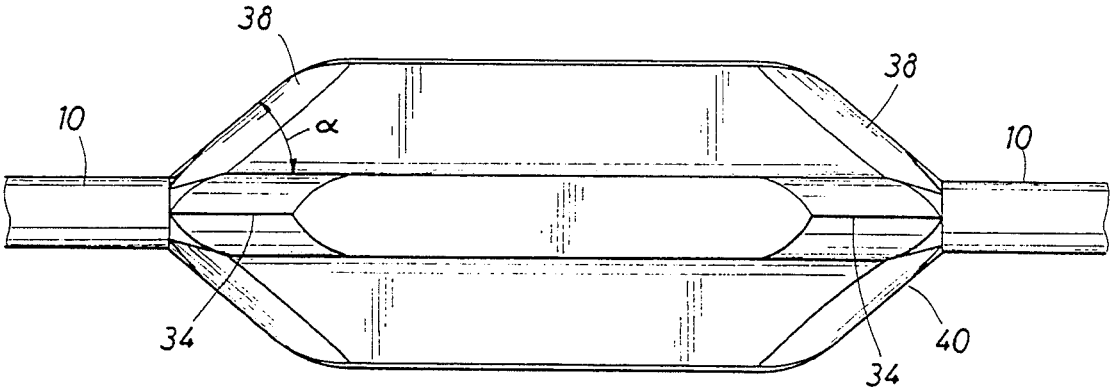
FIG. 5A depicts a side view of a rod guide of the present invention molded upon a relatively thin sucker rod and FIG. 5B depicts an end view of such a rod guide.

FIG. 3A depicts a further feature of the present invention. Each blade 30 defines a knife edge 34 that eliminates the flat face 22 of the prior art. Significantly, the knife edge 34 defines two independent angles: (1) the angle a of the knife edge with the axis of the sucker rod (see FIG. 5A) and (2) the angle between the faces 36 and 38 of the knife edge 34 (shown also in FIG. 3B). Each of these angles is independent of the other and is easily varied to suit each application and various sizes of sucker rods and production tubing. This knife edge 34 provides the advantage of reducing fluid resistance to the movement of the sucker rod and reduces or eliminates the turbulence behind the rod guide as the sucker rod moves in the downward direction. Note also that this structure eliminates the frustoconical cylinder 18 of the prior art rod guide of FIG. 2A.

From another point of view, the rod guide of the present invention presents a substantially star-shaped cross section with a smoothly continuous concave surface between the points of the star.

As shown in FIG. 3B, a dimension $d_3$ defines a minimum thickness of the body 28. This dimension varies depending upon the thickness or diameter of the sucker rod 10, as shown in FIGS. 4B and 5B.

Figure 4A:
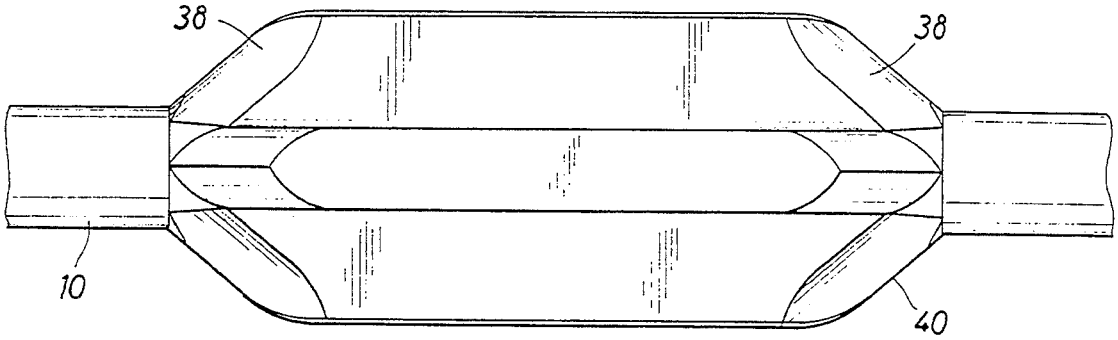
FIG. 4A depicts a side view of a rod guide of the present invention molded upon a relatively thick sucker rod and FIG. 4B depicts an end view of such a rod guide.
Figure 4B:
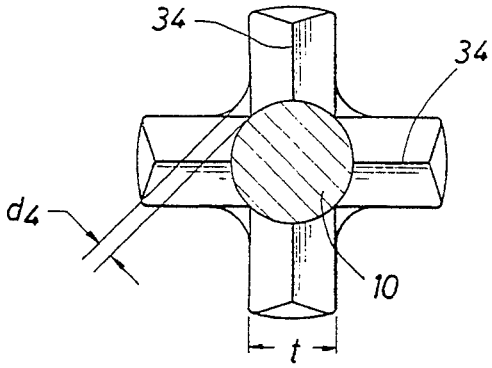
Figure 5B:
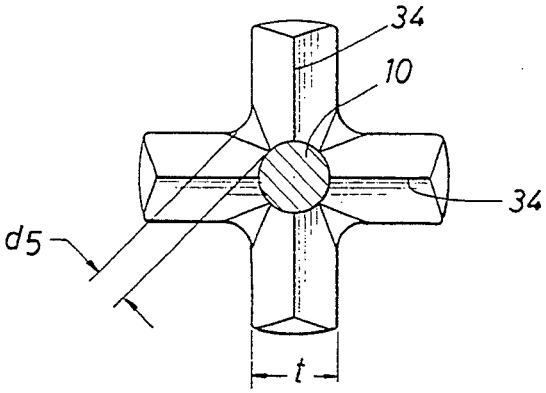

FIGS. 4A, 4B, 5A, and 5B provide a comparison of the structures of the present invention which depend on the thickness or diameter of the sucker rod 10. Various knife edges 34 and knife faces 38 are labeled to provide a context within the previous discussion regarding FIGS. 3A and 3B. FIG. 4B illustrates a representative dimension $d_4$ with a relatively large sucker rod 10 and FIG. 5B illustrates a representative dimension $d_5$ with a relatively small sucker rod 10. A thickness t defines the thickness of each fin. The thickness t is the same for each rod guide, regardless of the thickness of the sucker rod. By varying the dimensions $d_3$, $d_4$, and $d_5$, the cross-sectional area (between the rod guide and the production tubing, not shown) for fluid flow remains constant, and the "erodable volume" (i.e., the volume of rod guide plastic available to be eroded by contact with production tubing) also remains constant.

The present invention also presents a method of forming a rod guide on a sucker rod. The body of the rod guide with unitary fins or blades is molded directly upon a sucker rod. The rod guide must include at least three blades. The body defines a smoothly continuous concave surface between the blades. Each blade has formed at one or both edges a knife-blade. The angle that the knife-blade makes with the axis of the rod guide (and therefor the sucker rod) and the angle between the faces of the knife-blade are variable independently of one another. Note that the knife-blades are preferably formed on both ends of the fins to minimize fluid resistance and so that the sucker rod with guides formed thereon can be installed in the field with either end up.

Those of skill in the art will appreciate that the structure of the rod guide of the present invention, as shown in FIGS. 3A, 3B, 4A, 4B, 5A, and 5B, provides another significant advantage in the method of making the rod guide. Referring first to the prior art rod guide of FIG. 3A, the method a making this rod guide calls for an insert for the formation of the frustoconical cylinder 18 to accommodate the various sizes of rods. In known methods of forming the rod guide 12, the body 14 of the rod guide is the same for the various rod sizes and a separate mold insert is employed to adapt the rod guide to a particular sucker rod size. This method of making the rod guide results in nit lines where the plastic of the frustoconical cylinder (formed in a separate injection step) meets the plastic of the body and the blades. It has been found that these nit lines present additional weak spots for mechanical failure of rod guide.

The structure of the rod guide 26 of the present invention provides the advantage of a single injection molding step to form the entire unitary rod guide. This method eliminates the nit lines of the prior art thereby eliminating these weak spots. The method of the present invention of forming the rod guide comprises the steps of forming a unitary mold that defines a complete rod guide including a body with unitary projecting fins and a unitary body extension 40 (FIG. 3A) and forming the entire rod guide in a single injection molding step. Prior art methods of making a rod guide required the use of 6 separate pieces of mold form for each of 5 standard sucker rod sizes and for each of 3 standard tubing sizes. Thus, for each rod guide design, 90 pieces of mold form were required. The design of the present invention has reduced this number by a factor of six since a single mold form makes each rod guide.

The principles, preferred embodiment and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A rod guide comprising:

a. a substantially acylindrical body having a substantially star-shaped cross-section in intimate, molded contact with a sucker rod; and b. at least three blades projecting from the body and molded as a unitary structure with the body such that the body defines a smoothly continuous concave surface between the blades, wherein each blade has first and second axial ends and at least one of said ends of each blade defines a knife blade.

2. A method of installing a rod guide on a sucker rod comprising the steps of molding a unitary structure in intimate contact with sucker rod comprising a substantially acylindrical star-shaped body with at least three blades extending therefrom to define a smoothly continuous concave surface of the body between the blades.

3. The method of claim 2 further comprising the step of varying the minimum thickness of the body between the blades to accommodate sucker rods of varying diameters.

4. The method of claim 2 further comprising the step of forming a knife blade on at least one edge of each blade.

5. A rod guide comprising a body and a plurality of vanes formed on the body, the body and the vanes forming a substantially star-shaped cross section with the vanes forming points of a star and the body having a smoothly-continuous concave surface between said points of a star, wherein each point of the star defines a blade projecting axially from said body and at least one end of each blade defines a knife blade.

6. A method of forming a rod guide surrounding and in bonding contact with a sucker rod comprising the steps of:

forming a unitary mold that defines a complete elongated rod guide including a body with unitary projecting fins along a portion of the length of the body and a unitary body extension extending beyond the length of the fins, wherein the mold defines the sucker rod size and the size of the tubing for the rod guide without the use of inserts in the mold; and b. injecting a polymeric material into the mold formed in step a, to form a bonding surface between the rod guide and a sucker rod.

* * * * *